US008139794B2

(12) United States Patent
Chen et al.

(10) Patent No.: US 8,139,794 B2
(45) Date of Patent: Mar. 20, 2012

(54) SPEAKER DEVICES

(75) Inventors: Ming-Daw Chen, Hsinchu (TW); Chang-Ho Liou, Changhua County (TW)

(73) Assignee: Industrial Technology Research Institute, Hsinchu (TW)

( * ) Notice: Subject to any disclaimer, the term of this patent is extended or adjusted under 35 U.S.C. 154(b) by 541 days.

(21) Appl. No.: 12/370,598

(22) Filed: Feb. 13, 2009

(65) Prior Publication Data

US 2010/0027814 A1 Feb. 4, 2010

(30) Foreign Application Priority Data

Aug. 1, 2008 (TW) ..... 97129296 A

(51) Int. Cl.

| | |
|---|---|
| ***H04R 25/00*** | (2006.01) |
| ***H04R 1/20*** | (2006.01) |
| ***H04R 1/00*** | (2006.01) |
| ***H04R 1/02*** | (2006.01) |

(52) U.S. Cl. ..... 381/150; 381/345; 381/351; 381/385; 381/386

(58) Field of Classification Search ..... 381/150, 381/345, 351, 385; 382/386
See application file for complete search history.

(56) References Cited

U.S. PATENT DOCUMENTS

| | | | | |
|---|---|---|---|---|
| 3,894,199 | A | 7/1975 | Tamura et al. | |
| 3,935,397 | A * | 1/1976 | West | 381/191 |
| 6,806,593 | B2 * | 10/2004 | Tai et al. | 307/400 |
| 2007/0195976 | A1 | 8/2007 | Sekino et al. | |
| 2009/0016551 | A1 | 1/2009 | Chiang et al. | |
| 2009/0060233 | A1 | 3/2009 | Liou et al. | |
| 2009/0060234 | A1 | 3/2009 | Liou et al. | |
| 2009/0060249 | A1 | 3/2009 | Liou et al. | |
| 2009/0067648 | A1 | 3/2009 | Liou et al. | |
| 2009/0169036 | A1 | 7/2009 | Lee et al. | |
| 2009/0214049 | A1 | 8/2009 | Lee et al. | |
| 2009/0245547 | A1 | 10/2009 | Lee et al. | |
| 2009/0304212 | A1 | 12/2009 | Han et al. | |
| 2010/0024198 | A1 | 2/2010 | Chen et al. | |
| 2010/0027814 | A1 | 2/2010 | Chen et al. | |
| 2010/0034402 | A1 | 2/2010 | Lin et al. | |

FOREIGN PATENT DOCUMENTS

| | | |
|---|---|---|
| KR | 100751012 | 8/2007 |
| TW | I264960 | 10/2006 |
| TW | 200726300 | 7/2007 |
| TW | I294250 | 3/2008 |
| TW | 200939860 | 9/2009 |

OTHER PUBLICATIONS

"Office Action of Taiwan Counterpart Application of Co-pending application" issued on Oct. 13, 2010, p. 1-p. 6.

* cited by examiner

*Primary Examiner* — Long Tran
(74) *Attorney, Agent, or Firm* — Jianq Chyun IP Office

(57) ABSTRACT

A speaker device may include a substrate, a membrane above the substrate, and an electrode above the membrane, a plurality of first supporting members, and a plurality of second supporting members. The second chamber is enclosed between the membrane and the substrate, and the first chamber is enclosed between the electrode and the membrane. The first supporting members are provided in the first chamber space and may space the membrane apart from the electrode. The second supporting members are provided in the second chamber space and may space the membrane apart from the substrate.

33 Claims, 9 Drawing Sheets

SPEAKER DEVICES

RELATED APPLICATIONS

The application claims the priority benefit of Taiwan patent application serial no. 97129296, filed Aug. 1, 2008. The application is also related to a co-pending patent application submitted by the same applicants on Feb. 13, 2009 entitled "METHODS OF MAKING SPEAKERS" which claims the benefit of U.S. Provisional Application No. 61/107,328, filed Oct. 21, 2008. The entire disclosures, including the claims, of the aforesaid applications are hereby incorporated by reference herein and made a part of this specification.

BACKGROUND OF THE INVENTION

1. Field of the Invention

The present invention generally relates to speaker devices, and more particularly, to the structural designs of speaker devices.

2. Description of Related Art

Visual and acoustic means are two effective ways of communication. As a result, scientists and engineers have continued to develop components and systems for visual or acoustic applications. One acoustic application may include the use of speakers, including electro-acoustic speakers. Electro-acoustic speakers may be categorized as direct and indirect radiant speakers. Generally, speakers can also be roughly categorized, based on their operating theories, into dynamic speakers, piezoelectric speakers and electrostatic speakers. Dynamic or magnetic-membrane speakers have been frequently used because of their well-developed technologies and have dominated the speaker market. However, dynamic or magnetic-membrane speakers may have disadvantages due to their large sizes, making them less desirable for portable or smaller-sized consumer products or for other applications that have space constraints.

In contrast, piezoelectric speakers operate based on the piezoelectric effects of piezoelectric materials and rely the application of electrical fields to piezoelectric materials to drive sound-producing diaphragms or membranes. Piezoelectric speakers generally require less space and may have thin or planar designs. However, piezoelectric materials formed by sintering processes may be rigid and inflexible.

Additionally, electrostatic speakers are generally designed with two fixed electrode-plates having holes and holding a conductive membrane between the two plates for forming a capacitor. A DC voltage bias may be applied to the membrane, and an AC voltage may be applied to the two electrodes. The electrostatic force generated by the positive and negative fields may drive the conductive membrane to generate sound.

U.S. Pat. No. 3,894,199 illustrates an example of a conventional speaker design. Referring to FIG. 1, reproduced based on FIG. 2 of U.S. Pat. No. 3,894,199), an electro-acoustic transducer is used and includes two fixed electrodes 110 and 120 placed at the two sides of a membrane 130. Each of the two fixed electrodes 110 and 120 has holes for allowing the produced sound to pass through the electrodes. The membrane 130 is placed between the two electrodes 110 and 120. The electrodes 110 and 120 are connected to an AC signal or power supply 160 through a transformer 150. When the AC signal is applied to the electrodes 110 and 120, the variations in the voltage differences between the electrodes 110 and 120 cause the electrical field between the electrodes to vary, causing the membrane 130 to vibrate and produce sound.

The electro-acoustic transducer as illustrated may be bulky or expensive to make, and the design may provide limited efficiency in some applications. Therefore, it may be desirable to have alternative designs that may overcome, or be configured to overcome, one or more disadvantages associated with certain conventional designs of speakers.

SUMMARY OF THE INVENTION

One of the disclosed embodiments may include a speaker device. The speaker device may include a substrate, a membrane above the substrate, an electrode above the membrane, a frame, a plurality of first supporting members, and a plurality of second supporting members. Specifically, the second chamber is enclosed between the membrane and the substrate, and the first chamber is enclosed between the electrode and the membrane. The frame is coupled with the substrate, the membrane, and the electrode to form a stacked structure having the first chamber between the electrode and the membrane and having the second chamber between the substrate and the membrane. The first supporting members are provided in the first chamber space and may be coupled between the electrode and the membrane. The first supporting members may space the membrane apart from the electrode. The second supporting members are provided in the second chamber space and may be coupled between the membrane and the substrate. The second supporting members may space the membrane apart from the substrate.

Another of the disclosed embodiments may include a speaker device, which may include a substrate, a membrane above the substrate, an electrode above the membrane, a plurality of first supporting members, and a plurality of second supporting members. Specifically, the second chamber is enclosed between the membrane and the substrate, and the first chamber is enclosed between the electrode and the membrane. The first supporting members are provided in the first chamber space and may space the membrane apart from the electrode. The second supporting members are provided in the second chamber space and may space the membrane apart from the substrate.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
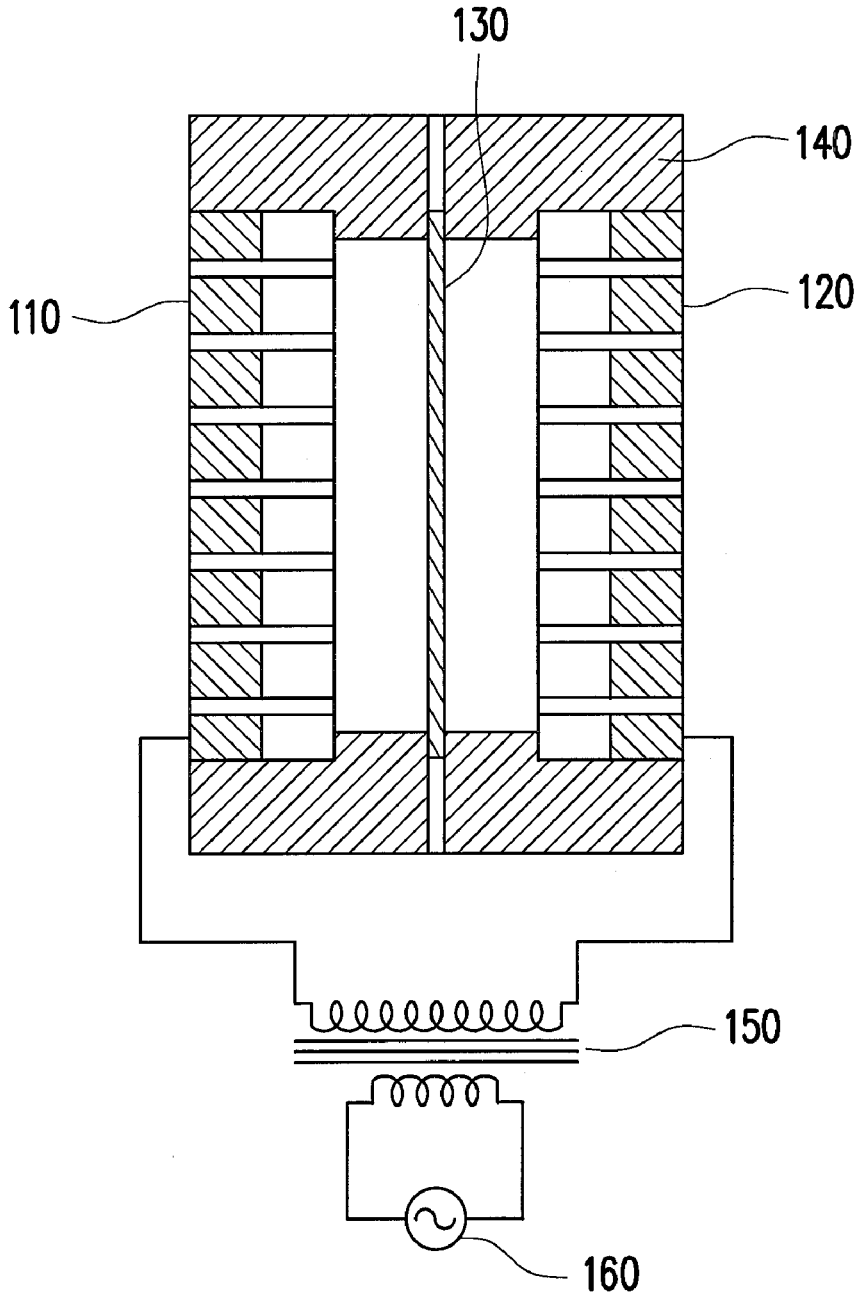
FIG. 1 (PRIOR ART)
FIG. 1 is a diagram of a conventional electroacoustic transducer in the prior art.

Reference will now be made in detail to the present preferred embodiments of the invention, examples of which are illustrated in the accompanying drawings. Wherever possible, the same reference numbers are used in the drawings and the description to refer to the same or like parts.

Embodiments of the present invention may provide flat electrostatic speakers or speaker chamber structures that may be light, thin and/or flexible. Such embodiments may suit the current demand for flat or thin electrostatic speakers and may occupy less space or provide flexibilities in the speaker structures themselves.

In some embodiments, a speaker device may include a substrate, a diaphragm or membrane above the substrate, an electrode above the membrane, a plurality of first supporting members, and a plurality of second supporting members. Specifically, the first or upper chamber is enclosed between the electrode and the membrane, and the second or lower chamber is enclosed between the membrane and the substrate. The first supporting members are provided in the upper chamber space, and the second supporting members are provided in the lower chamber space, which may be called a sound-chamber.

In some embodiments, the supporting members may have different patterns in placing the members or heights, which can be varied based on different applications or specifications. The sound-chamber structure may be placed in a space opposite to a soniferous hole region, i.e., the upper chamber, of the speaker, and the positions of the first supporting members and of the second supporting members may be symmetrical. The structure design and layout of the sound-chamber supporting members may improve the frequency response of the speaker. In various embodiments, the number of the first supporting members can be greater than, equal to, or less than the number of the second supporting members depending on various design requirements or considerations.

In some embodiments, the sound-chamber structure of a flat electrostatic speaker can be fabricated through integrating the existing processes of making flat electrostatic speakers and therefore may be suitable for mass production.

The flat electrostatic speaker may operate based on the principle that when a membrane is stimulated by an external voltage, the surface of the membrane deforms based on the charge characteristics of the membrane material and the electrostatic force. The deformations of the membrane drive the air surrounding the membrane to produce sound. The force exerted onto the membrane can be derived or estimated based on an electrostatic force formulas. As an example, the force may be the product resulting from multiplying the capacitance of the entire speaker by the internal electric field and the input voltage. Generally, the larger the force exerted onto the membrane is, the greater the sound output becomes.

Electrostatic speakers may be designed to be light, thin and/or flexible. In some embodiments, a sound-chamber structure with light, thin and/or flexible features may be placed in a space opposite to the soniferous hole regions of the speaker. The sound-chamber structure may include a plurality of appropriate sound-chamber supporting members, which may be the second supporting members, placed on a substrate. The sound-chamber supporting members and the supporting members can be respectively fabricated or formed on the substrate or the membrane electrode. The supporting members can be placed on the sound-chamber electrode or the membrane electrode with or without adhesives. The sound-chamber supporting members can also be manufactured in advance, followed by placing them between the membrane electrode and the substrate. The layout of the sound-chamber supporting members may be varied based on one or more design considerations, such as the electrostatic effect of the membrane, its frequency response, etc.

The layout design of the sound-chamber supporting members may vary based on the placement of the supporting members in a flat electrostatic speaker. On the other hand, the supporting members, which may be the first supporting members, located in the space of the flat electrostatic speaker opposite to the sound-chamber supporting members, may be designed with different patterns or heights based on audio-frequency characteristics. In one embodiment, the sound-chamber may contain sound-absorbing material, which may enhance the far-field effect and/or omni-directivity effect of the sound field.

The sound-chamber structure design of a flat electrostatic speaker in one embodiment may include sound-chamber supporting members in a chamber space. The design of the sound-chamber supporting members may be adjusted or optimized based on design considerations such as acoustic frequency requirements, frequency responses, or other acoustic or structural factors. The design variations may include at least variations in the placements and heights of the supporting members. As an example, the sound-chamber supporting members may have a spot-shape, a grid-shape, a cross-like-shape, any other shapes, or a combination of two or more shapes. Formulating a design under different design considerations may also include adjusting the distance between any two adjacent sound-chamber supporting members according to acoustic frequency requirements, frequency responses, or other acoustic or structural considerations.

Sound-chamber supporting members may be fabricated on a substrate using transfer printing, transfer adhesion, or direct printing such as inkjet printing or screen printing. In another embodiment, the supporting members may be fabricated by direct adhesion. As an example, the supporting members may be fabricated in advance, followed by placing the pre-fabricated supporting members between a metal electrode with holes and the membrane. The supporting members may be placed on the membrane or the metal electrode with holes with direct adhesion or without direct adhesion to the underlying membrane or electrode. In other embodiments, the supporting members can be fabricated using etching, photolithography, and/or adhesive-dispensing techniques.

In some embodiments, a speaker unit may include a single metal electrode and a single membrane having electric charges. Taking advantage of a flexible membrane having electrets, a speaker unit may be fabricated using a continuous or partially continuous roll-to-roll process. In contrast, the conventional process may require a specific design and production flow, which generates a specific, individual speaker-design for mass producing the same design. A mass production manufacturing method usually forms the speaker membranes and the speakers individually based on the same design, which can be difficult to modify during the manufacturing process. As an example, the roll-to-roll process consistent with the disclosed embodiments may be conducted with stamping, press casting and adhesion processes to form the primitive products (i.e. the membranes) of speakers. The membranes may be formed with a large area, such as being formed as a roll of membrane. The proposed process may significantly reduce the fabrication cost of speakers. In particular, the primitive products in roll shapes may offer flexibilities in having or fabricating various designs, especially designs that may require large areas, irregular shapes, or customized shapes or designs that have many variations.

Figure 2:
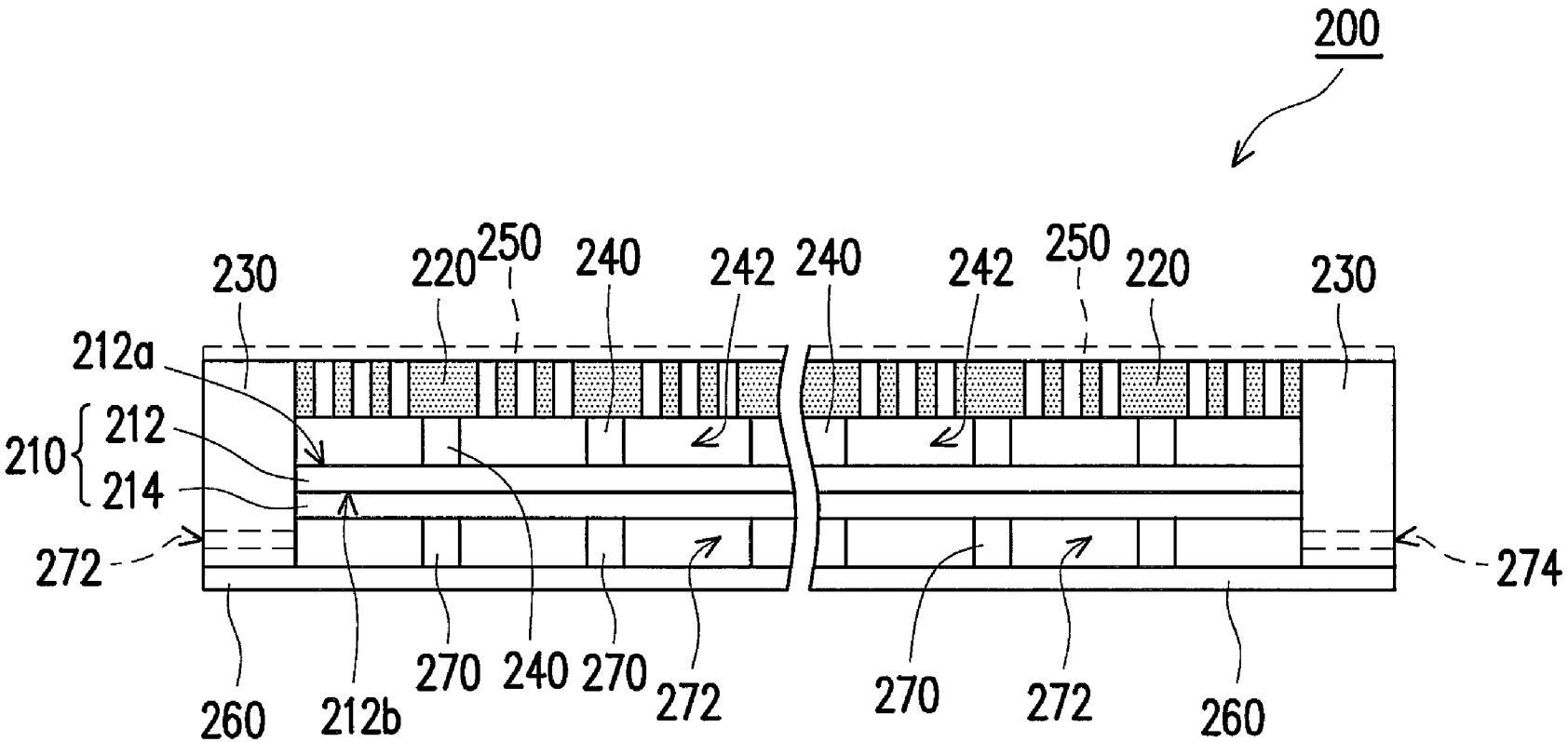
FIG. 2 is a sectional diagram of a structure of a speaker unit according to an embodiments consistent with the present invention.

Referring to FIG. 2, a speaker 200 may have several working areas for a membrane 210 located between any two adjacent supporting members. The two sides of the membrane 210 may have their respective working areas defined in the same way or defined differently. The sound-chamber structure as illustrated may have two chamber spaces, one above the membrane 210 and one below it, for producing the resonant sound fields or effects of the speaker. The speaker 200 may have a plurality of supporting members, which may be designed with specific shapes and placements within the upper and lower chamber spaces. In one embodiment, the upper chamber space in FIG. 2 may be a soniferous hole region, and the lower chamber space in FIG. 2 opposite to the soniferous hole region may be a sound-chamber structure 272. The lower chamber space between a substrate 260 and the membrane 210 may produce the resonant sound field of the speaker 200 through a plurality of working areas of the membrane located between any two adjacent sound-chamber supporting members.

The speaker unit 200 may include the membrane 210, an electrode layer 220 with a plurality of holes, a frame 230 and a plurality of upper-chamber supporting members 240 between the electrode layer 220 and the membrane 210. At the side of the membrane 210 opposite to the electrode layer 220, there is the sound-chamber structure 272, which may be enclosed or partially-enclosed by substrate 260 and a plurality of sound-chamber (or lower-chamber) supporting members 270 between the membrane 210 and the substrate 260. The membrane 210 may include an electret layer 212 and a metal film electrode 214. In some embodiments, a top surface 212*a* of the electret layer 212 may be conductively coupled to the frame supporting member 230 and the supporting members 240, and a lower surface 212*b* of the electret layer 212 may be conductively coupled to the above-mentioned metal film electrode 214. An insulation layer 216 may be sandwiched between the electret layer 212 and the electrode 214.

The electrode layer 220 with holes can be made of metal. In one embodiment, the electrode layer 220 can be made of an elastic material, such as paper or an extremely-thin, nonconductive material, plated with a metal film on the paper or the nonconductive material.

When the electrode layer 220 is made of a nonconductive material layer plated with a metal film layer, the nonconductive material can be plastic, rubber, paper, nonconductive cloth (cotton fiber or polymer fiber) or other nonconductive materials; and the metal film can be aluminium, gold, silver, copper, Ni/Au bimetal, indium tin oxide (ITO), indium zinc oxide (IZO), macromolecule conductive material PEDOT (polyethylenedioxythiophene), etc.; an alloy; or any combination of the listed materials or equivalents thereof. When the electrode layer 220 uses a conductive material, the conductive material can be metal (e.g., iron, copper, aluminum or an alloy thereof), conductive cloths (e.g., metal fiber, oxide metal fiber, carbon fiber or graphite fiber), etc., or any combination of these materials or other materials.

The electret layer 212 can be a dielectric material, which may be treated or electrified to allow it to keep static charges for a period of time or an extended period of time and have a stationary electric or static effect within the material after being charged. Therefore, the electret layer 212 is also known as an electret membrane layer. The electret layer 212 may have one or multiple dielectric layers. Example of the dielectric materials include FEP (fluorinated hylenepropylene), PTFE (polytetrafluoethylene), PVDF (polyvinylidene fluoride), fluorine polymer materials, or other appropriate materials. The dielectric material may include holes having diameters in micro-scale or nanometer-scale. Because the electret layer 212 may keep static charges for an extended period of time and may have piezoelectric characteristics after being subjected to an electrifying treatment, the holes within the membrane may increase transmission and enhance piezoelectric characteristics of the material. In one embodiment, after corona charging, dipolar charges may be produced and kept within the dielectric material to produce stationary electric or static effect.

To provide good tension and/or vibration effects of the membrane 210, the metal film electrode 214 may be a thin metal film electrode. As an example, its thickness may be between 0.2 micron and 0.8 micron or between 0.2 micron and 0.4 micron. It may be about 0.3 micron in some embodiments. The scale range illustrated is usually identified as "ultra-thin."

Taking the electret layer 212 with negative charges as an example, when an input audio signal is supplied to the electrode layer 220 with holes and the metal film electrode 214, a positive voltage from the input signal may produce an attracting force on the negative charges of the electret membrane, and a negative voltage from the input signal may produce a repulsive force on the positive charges of the unit so as to make the membrane 210 move in one direction.

In contrast, when the voltage phase of the input sound source signal is changed, a positive voltage may produce an attracting force on the negative charges of the electret membrane, and a negative voltage may produce a repulsive force on the positive charges of the unit so as to make the membrane 210 move in the direction opposite to the above-mentioned direction. The electret membrane may move back-and-forth repeatedly and vibrate to compress the surrounding air to produce sound through the interaction of different forces in different directions.

The speaker unit 200 in one embodiment can be covered by a film 250 on one side or on both sides. The film 250 may be air-permeable but waterproof and made of, for example, GORE-TEX® film containing ePTFE (expanded polytetrafluoroethylene), etc. GORE-TEX® or a similar material may be capable of preventing the effects of water and oxygen so as to prevent the electret layer 212 from leaking its charges and having its stationary electric effect reduced.

A plurality of working areas of membrane 210 may be formed between any two adjacent supporting members 240 and between the above-mentioned electrode layer 220 and the membrane 210. These working areas in the upper chamber space 242 may be used for producing resonant sound fields of the speaker 200. A plurality of working areas of membrane 210 may be formed between any two adjacent sound-chamber supporting members 270 and between the substrate 260 and the membrane 210. These working areas in the lower chamber space 272 may also be used for producing resonant sound fields of the speaker 200. Both the supporting members 240 and the sound-chamber supporting members 270 may be adjusted, as part of the speaker design, in their placements in the chambers, their heights, and their shapes. In addition, the number of the sound-chamber supporting members 270 can be greater than, equal to or less than the number of the supporting members 240, and the supporting members 240 or the sound-chamber supporting members 270 can be fabricated directly on or over the electrode layer 220 or the substrate 260.

Figure 3:
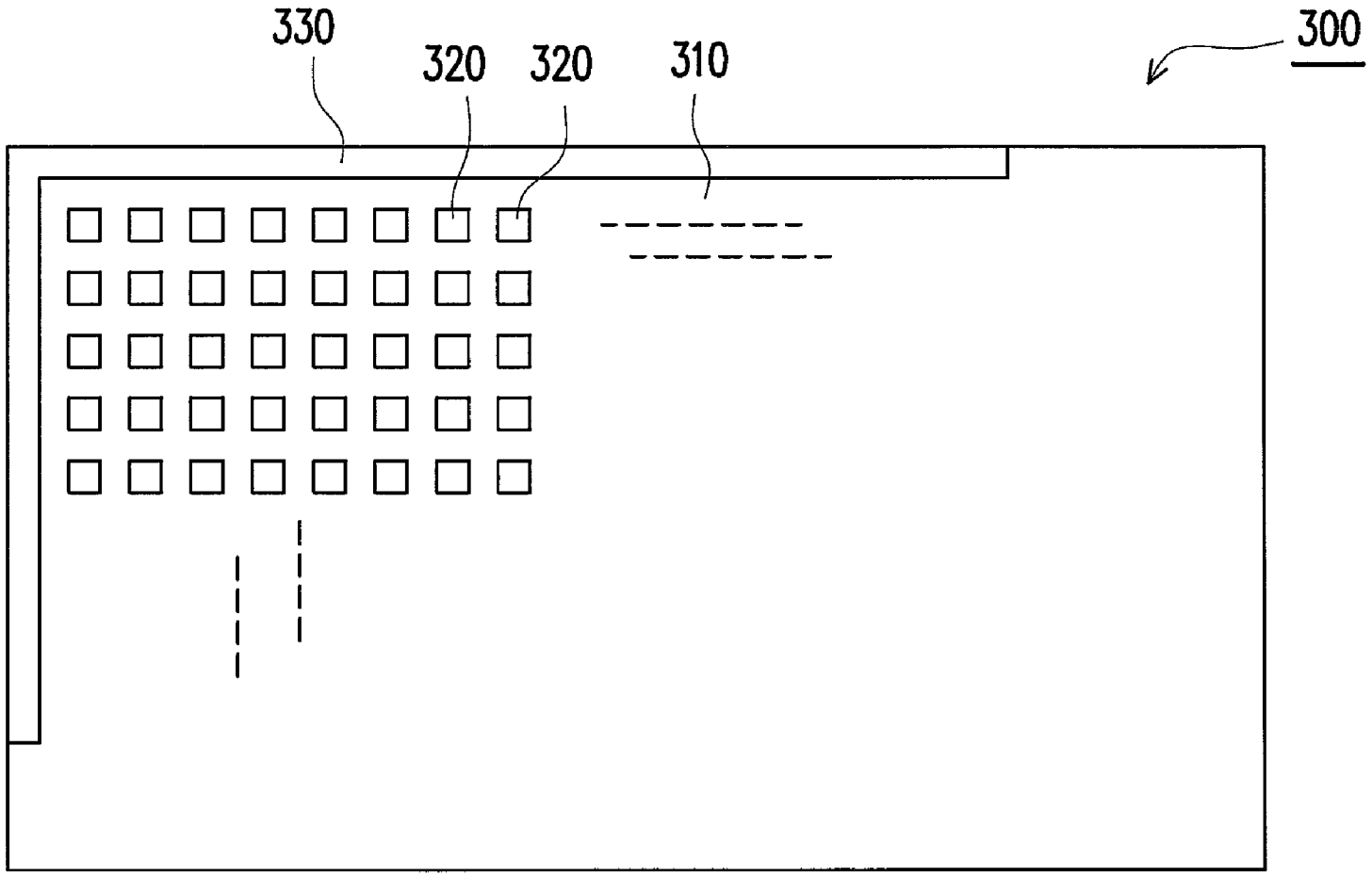
FIGS. 3-8 are the top views of various sound-chamber structures of a speaker unit according to embodiments consistent with the present invention.

The sound-chamber structure is near the surface of the metal film electrode 214 of the membrane 210 and may be designed by considering the audio-frequency characteristic of the speaker or other acoustic or structural factors. The sound-chambers may include a sound-absorbing material; and the supporting members or the sound-chamber supporting members may be designed in various shapes. The chamber space formed by the frame supporting member 230 may have a sound hole 274 in the frame supporting member 230 for releasing the pressure of produced sound and, in some instances, create a better sound field effect. Referring to FIG. 3, a top view of a sound-chamber structure 300 illustrates a substrate 310 and sound-chamber supporting members 320 between a membrane (not shown) and the substrate 310. A frame supporting member 330, illustrated partially, may be placed surrounding the sound-chamber structure 300. The sound-chamber supporting members 320 are spot-shaped and placed on the membrane electrode, the substrate, or both. The sound-chamber supporting members 320 in the embodiment may be evenly arranged in a matrix, and the distance between the adjacent sound-chamber supporting members 320 may be varied based on design considerations discussed above.

Figure 4:
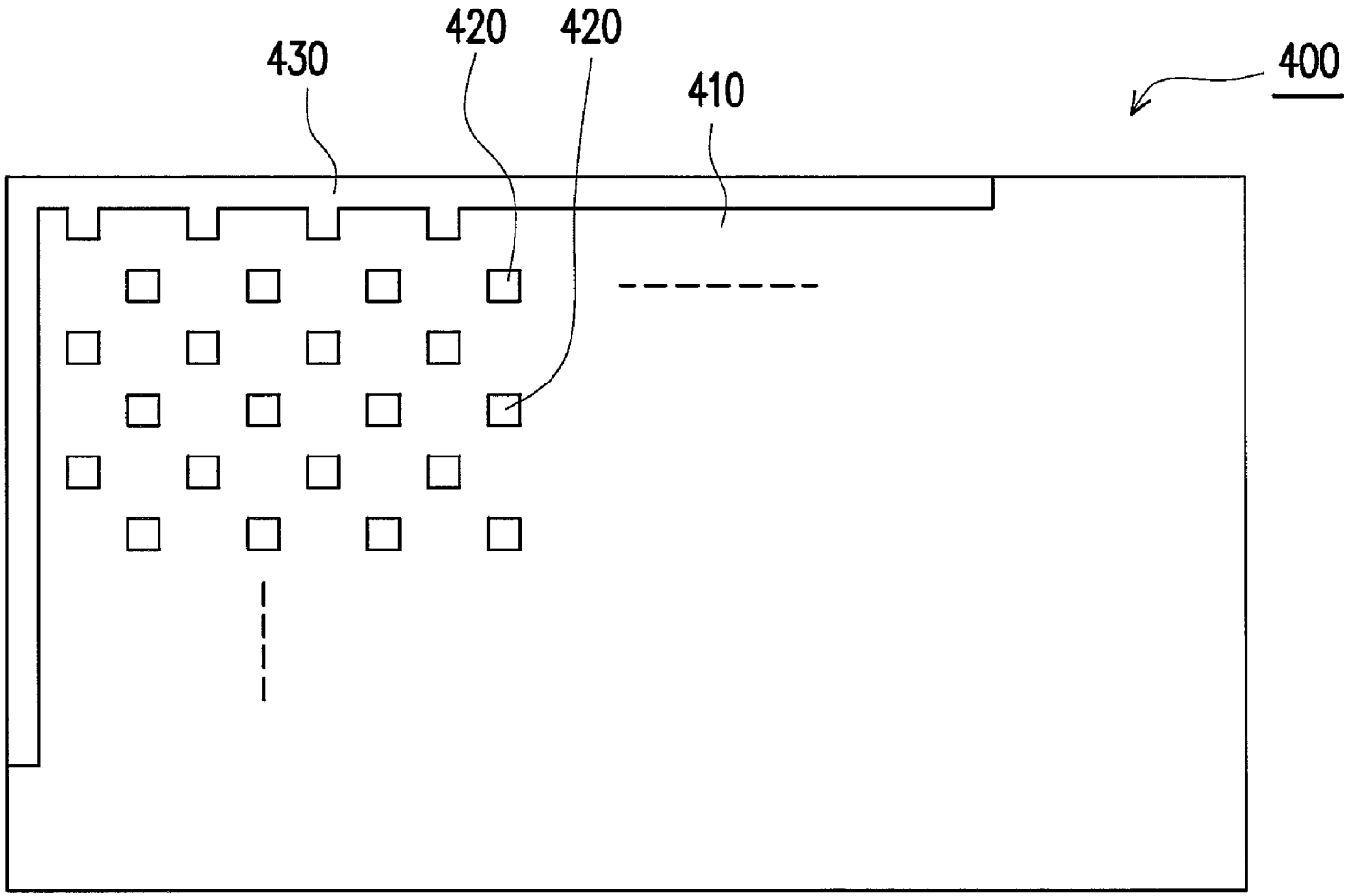

Referring to FIG. 4, a top view of a sound-chamber structure 400 illustrates a substrate 410 and sound-chamber supporting members 420 between a membrane (not shown) and the substrate 410. A frame supporting member 430, illustrated partially, may be placed surrounding the sound-chamber structure 400. The sound-chamber supporting members are spot-shaped and placed on the membrane electrode, the substrate, or both. The sound-chamber supporting members 420 in the embodiment may be arranged in a staggered pattern, such as the pattern illustrated, and the distance between the adjacent sound-chamber supporting members 420 may be larger than that of the members shown in FIG. 3.

Figure 5:
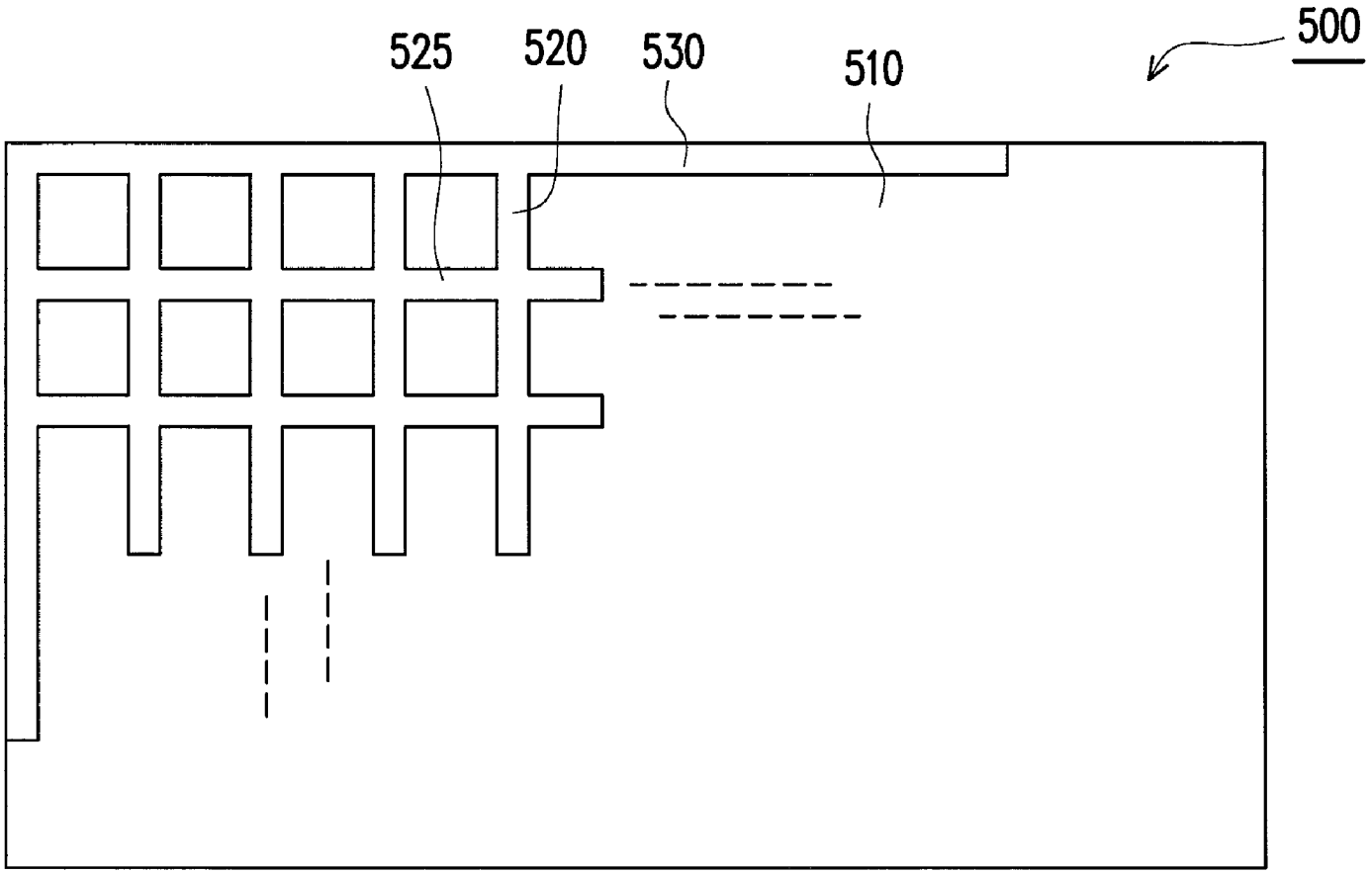

Referring to FIG. 5, a top view of a sound-chamber structure 500 illustrates a substrate 510 and sound-chamber supporting members between a membrane (not shown) and the substrate 510. A frame supporting member 530, illustrated partially, may be placed surrounding the sound-chamber structure 500. The sound-chamber supporting members are bar-shaped, such as the bar-shaped sound-chamber supporting members 520 and 525 in FIG. 5, and may form a grid pattern as illustrated. The bar-shaped sound-chamber supporting members in the embodiment may be arranged in a staggered way, and the width of each bar-shape supporting member, the transverse distances and the longitudinal distances between the adjacent sound-chamber supporting members may be determined based on design considerations illustrated above.

Figure 6:
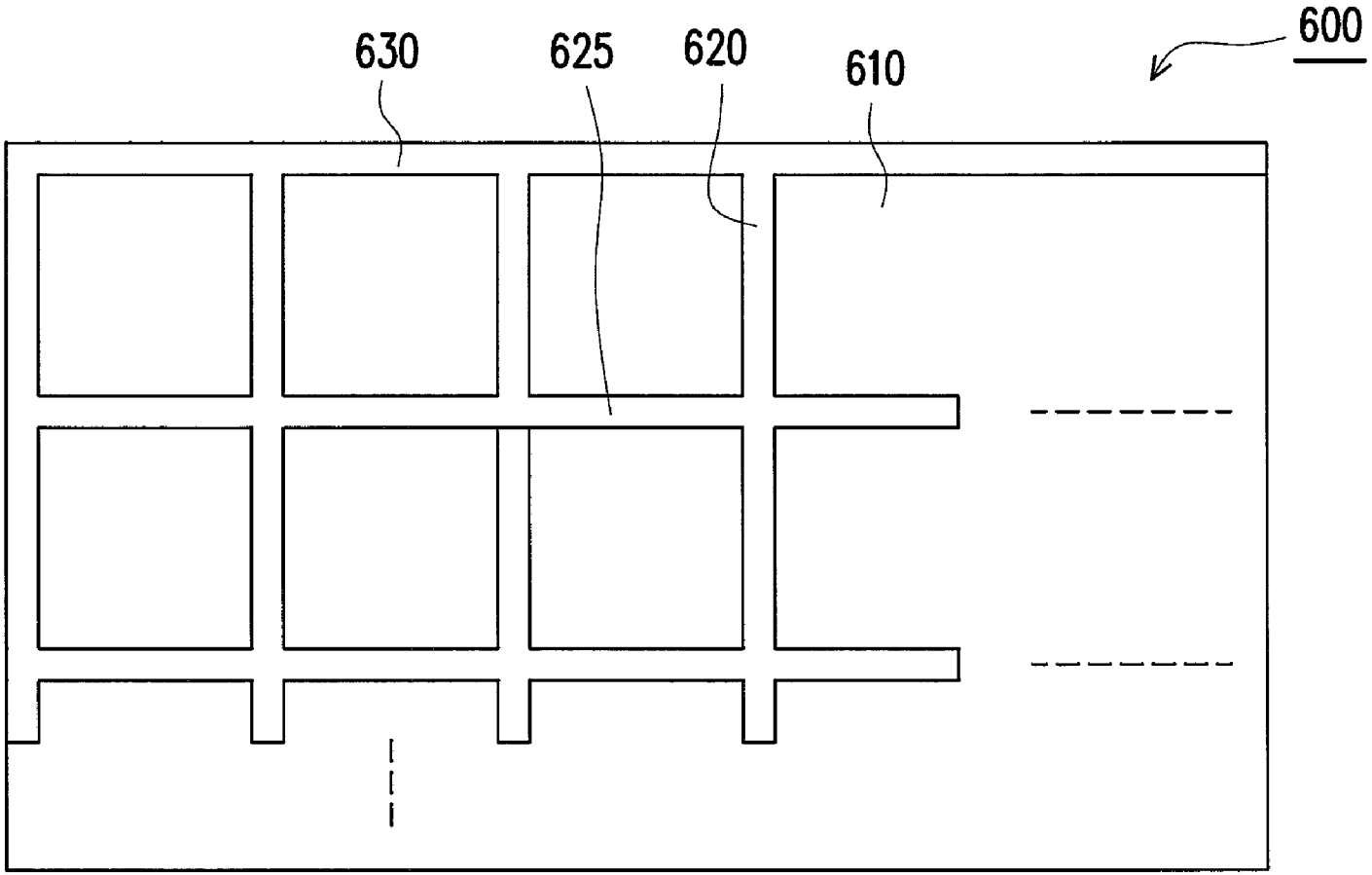

Referring to FIG. 6, a top view of a sound-chamber structure 600 illustrates a substrate 610 and bar-shape sound-chamber supporting members between a membrane and the substrate 610. A frame supporting member 630, illustrated partially, may be placed surrounding the sound-chamber structure 600. The sound-chamber supporting members are bar-shaped, such as for example, the bar-shaped sound-chamber supporting members 620 and 625 in FIG. 6, and may be arranged in a staggered way or form a grid pattern as illustrated. Compared with FIG. 5, the width of each bar-shaped supporting member may be smaller, but the transverse distance and the longitudinal distances between the adjacent sound-chamber supporting members may be larger. These factors may be varied based on the designed considerations discussed above.

Figure 7:
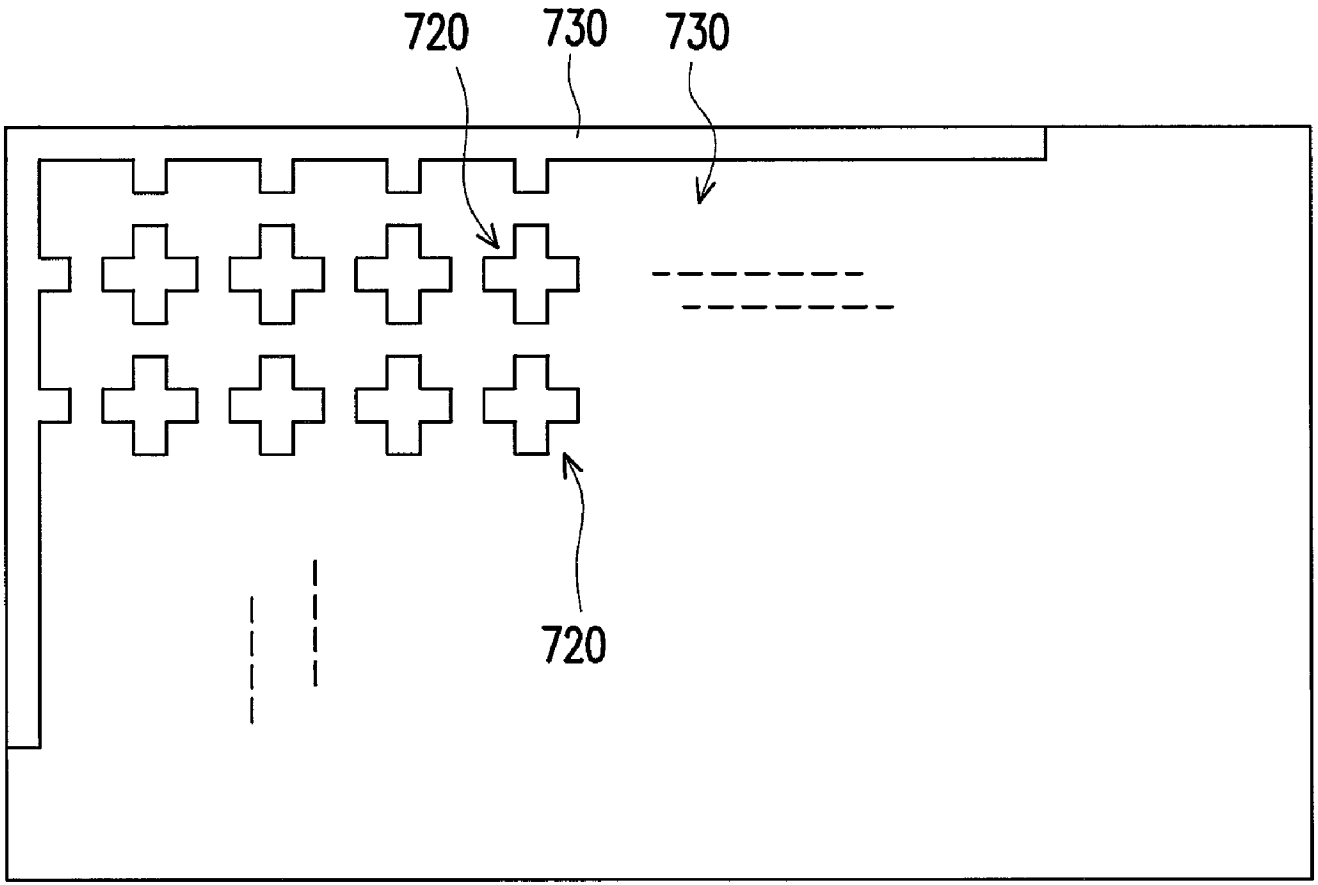

Referring to FIG. 7, a top view of a sound-chamber structure 700 illustrates a substrate 710 and sound-chamber supporting members 720 between a membrane and the substrate 710. A frame supporting member 730, illustrated partially, may be placed surrounding the sound-chamber structure 700. The sound-chamber supporting members are cross-shaped and evenly arranged in a matrix, and the distance between the adjacent sound-chamber supporting members 720 is determined by an optimum design according to the sound frequency requirement.

Figure 8:
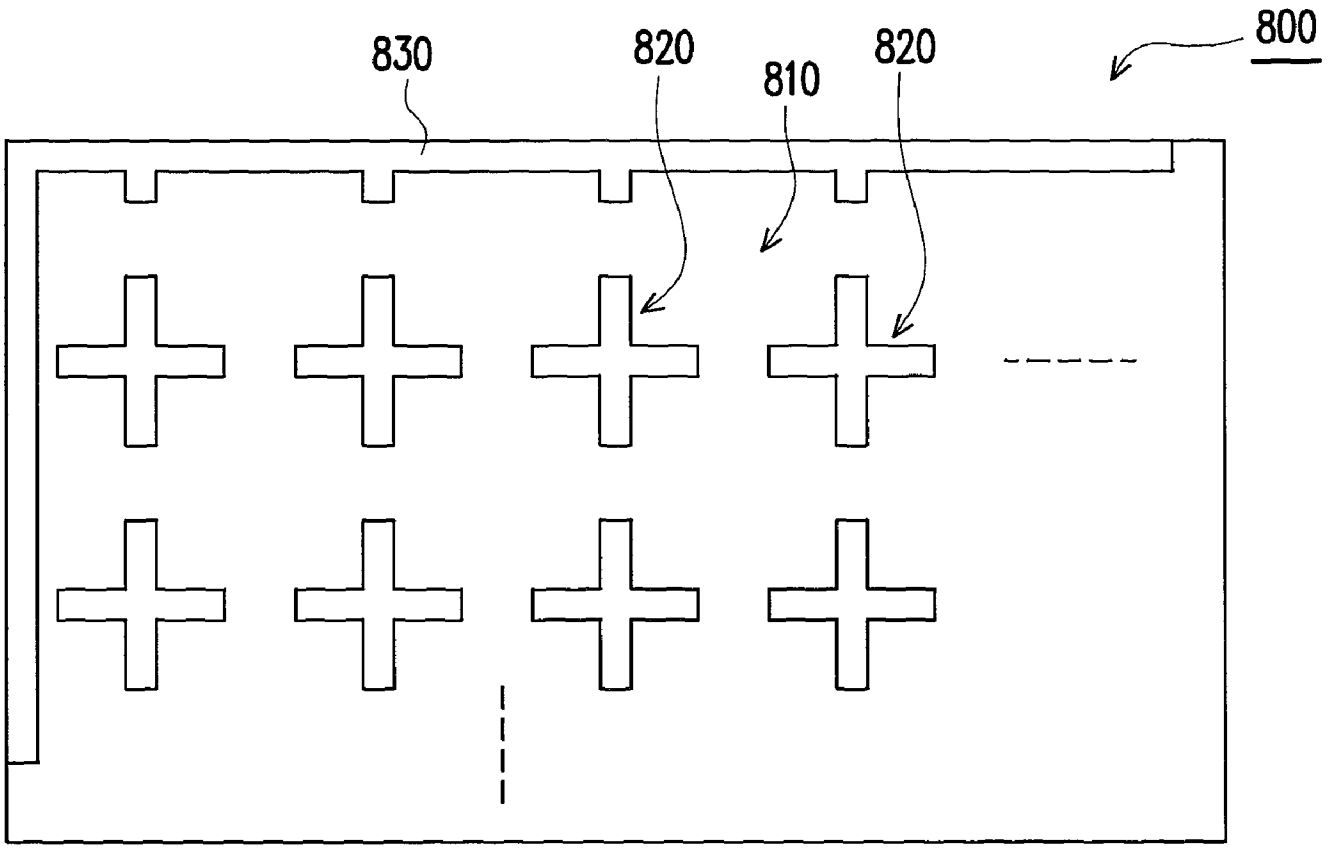

Referring to FIG. 8, a top view of a sound-chamber structure 800 illustrates a substrate 810 and sound-chamber supporting members 820 between a membrane and the substrate 810. A frame supporting member 830 is placed surrounding the sound-chamber structure 800. The sound-chamber supporting members are cross-shaped. In comparison with FIG. 7, the width of each cross-shape supporting member is smaller but each member is longer, and the transverse distance and the longitudinal distances between the adjacent sound-chamber supporting members are larger and all the above-mentioned parameters are determined by an optimum design according to the sound frequency requirement.

Figure 9:
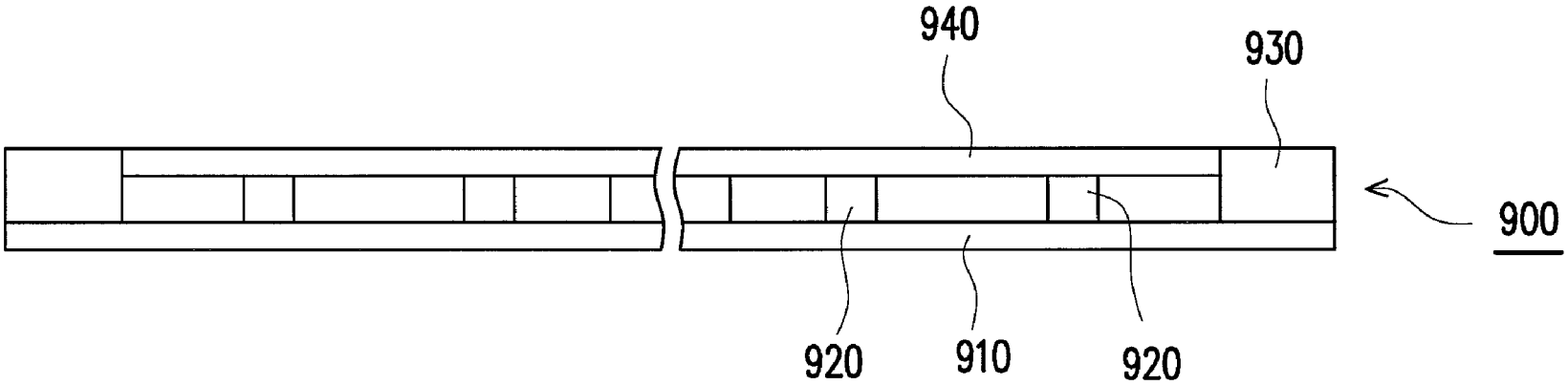
FIG. 9 is a cross-sectional view of a sound-chamber structure of a speaker unit according to embodiments consistent with the present invention.

Referring to FIG. 9, in another embodiment, a side sectional view of a sound-chamber structure 900 illustrates a substrate 910 and sound-chamber supporting members 920 between a membrane 940 and the substrate 910. A frame supporting member 930 is placed surrounding the sound-chamber structure 900. The distances between the adjacent sound-chamber supporting members 920 are different from each other, and are individually adjusted according to the design of the structure of a speaker unit. Note that the distances are not necessarily the same.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A speaker device, comprising:

a substrate;

a membrane above the substrate, the membrane and the substrate having a second chamber enclosed between the membrane and the substrate;

an electrode above the membrane, the electrode having a plurality of holes, the electrode and the membrane having a first chamber enclosed between the electrode and the membrane;

a frame coupled with the substrate, the membrane, and the electrode to form a stacked structure having the first chamber between the electrode and the membrane and having the second chamber between the substrate and the membrane;

a plurality of first supporting members in the first chamber space and being coupled between the electrode and the membrane, the plurality of first supporting members spacing the membrane apart from the electrode; and a plurality of second supporting members in the second chamber space and being coupled between the membrane and the substrate, the plurality of second supporting members spacing the membrane apart from the substrate;

wherein the membrane comprises an electret layer and a conductive electrode layer;

at least some of the first and second supporting members have height variations from others; and at least one of the first and second supporting members is made of a flexible material.

2. The speaker device according to claim 1, wherein the first and second supporting members have the same placement patterns respectively within the first and second chambers.

3. The speaker device according to claim 1, wherein the number of the second supporting members is greater than, equal to, or less than the number of the first supporting members.

4. The speaker device according to claim 1, wherein a placement pattern of at least one of the first and second supporting members is determined based on an electrostatic effect of the membrane or frequency response.

5. The speaker device according to claim 1, wherein distances between adjacent supporting members are determined based on an electrostatic effect of the membrane or frequency response.

6. The speaker device according to claim 1, wherein at least some of the first and second supporting members have at least one of a spot shape, a triangular or prism shape, a cylindrical shape, a rectangular shape, and irregular shape.

7. The speaker device according to claim 1, wherein the first supporting members are formed on at least one of the electrode and the membrane by at least one of transfer printing, inkjet printing, screen printing, transfer adhesion, etching, photolithography.

8. The speaker device according to claim 7, wherein the first supporting members are formed on at least one of the electrode and the membrane by transfer adhesion and at least some of the first supporting members are adhered to at least one of the membrane and the electrode.

9. The speaker device according to claim 7, wherein the first supporting members are formed on at least one of the electrode and the membrane by transfer adhesion and without having at least some of the first supporting members adhere to at least one of the membrane and the electrode.

10. The speaker device according to claim 1, wherein the second supporting members are formed on at least one of the membrane and the substrate by at least one of transfer printing, inkjet printing, screen printing, transfer adhesion, etching, photolithography.

11. The speaker device according to claim 10, wherein the second supporting members are formed on at least one of the membrane and the substrate by transfer adhesion and at least some of the second supporting members are adhered to at least one of the membrane and the substrate.

12. The speaker device according to claim 10, wherein the second supporting members are formed on at least one of the membrane and the substrate by transfer adhesion and without having at least some of the second supporting members adhere to at least one of the membrane and the substrate.

13. The speaker device according to claim 1, wherein the first supporting or the second supporting members are arranged in a regular, irregular, or grid pattern.

14. The speaker device according to claim 1, wherein the electrode is made of metal.

15. The speaker device according to claim 1, wherein the electrode is formed by plating a metal film on a layer of nonconductive material.

16. The speaker device according to claim 15, wherein the nonconductive material comprises at least one of plastic, rubber, paper, nonconductive cloth, cotton fiber and polymer fiber.

17. The speaker device according to claim 15, wherein the metal film comprises at least one of aluminium, gold, silver, copper or alloy thereof, Ni/Au bimetal, indium tin oxide (ITO) and indium zinc oxide (IZO).

18. The speaker device according to claim 15, wherein the thickness of the metal film is from 0.2 micron to 0.8 micron.

19. The speaker device according to claim 15, wherein the thickness of the metal film is from 0.2 micron to 0.4 micron.

20. The speaker device according to claim 15, wherein the thickness of the metal film is 0.3 micron.

21. The speaker device according to claim 1, wherein the electret layer comprises at least one layer of dielectric material having at least one of FEP (fluorinated hylenepropylene), PTFE (polytetrafluoethylene), PVDF (polyvinylidene fluoride), and a fluorine polymer material.

22. A speaker device, comprising:

a substrate;

a membrane above the substrate, the membrane and the substrate having a second chamber enclosed between the membrane and the substrate;

an electrode above the membrane, the electrode having a plurality of holes, the electrode and the membrane having a first chamber enclosed between the electrode and the membrane;

a plurality of first supporting members being coupled between the electrode and the membrane, the plurality of first supporting members spacing the membrane apart from the electrode; and a plurality of second supporting members in the second chamber space, the plurality of second supporting members spacing the membrane apart from the substrate;

wherein the membrane comprises an electret layer and a conductive electrode layer;

a placement pattern of at least one of the first and second supporting members is determined based on an electrostatic effect of the membrane or frequency response;

distances between adjacent supporting members are determined based on an electrostatic effect of the membrane or frequency response; and the first and second supporting members have the same placement patterns respectively within the first and second chambers.

23. The speaker device according to claim 22, further comprising a frame coupled with the substrate, the membrane, and the electrode to form a stacked structure having the first chamber between the electrode and the membrane and having the second chamber between the substrate and the membrane.

24. The speaker device according to claim 22, wherein at least some of the first and second supporting members have height variations from others.

25. The speaker device according to claim 22, wherein at least some of the first and second supporting members have at least one of a spot shape, a triangular or prism shape, a cylindrical shape, a rectangular shape, and irregular shape.

26. The speaker device according to claim 22, wherein the first supporting members are formed on at least one of the electrode and the membrane by at least one of transfer printing, inkjet printing, screen printing, transfer adhesion, etching, photolithography.

27. The speaker device according to claim 22, wherein the second supporting members are formed on at least one of the membrane and the substrate by at least one of transfer~printing, inkjet printing, screen printing, transfer adhesion, etching, photolithography.

28. The speaker device according to claim 22, wherein at least one of the first and second supporting members is made of a transparent and flexible material.

29. The speaker device according to claim 22, wherein the first supporting members or the second supporting members are arranged in a regular, irregular, or grid pattern.

30. The speaker device according to claim 22, wherein the electrode is made of metal.

31. The speaker device according to claim 22, wherein the electrode is formed by plating a metal film on a layer of nonconductive material.

32. The speaker device according to claim 31, wherein the thickness of the metal film is from 0.2 micron to 0.8 micron.

33. The speaker device according to claim 22, wherein the electret layer comprises at least one layer of dielectric material having at least one of FEP (fluorinated hylenepropylene), PTFE (polytetrafluoethylene), PVDF (polyvinylidene fluoride), and a fluorine polymer material.

* * * * *